US005168999A

United States Patent [19]

Lee et al.

[11] Patent Number: 5,168,999

[45] Date of Patent: Dec. 8, 1992

[54] SYSTEM FOR PACKAGING STRING LIGHTS

[75] Inventors: Kuo-Hsing K. Lee, Watauga; B. Paul Fratello, Arlington, both of Tex.

[73] Assignee: Continential Lighting Ind. Inc., Houston, Tex.

[21] Appl. No.: 723,460

[22] Filed: Jun. 28, 1991

[51] Int. Cl.[5] ..... B65D 85/42

[52] U.S. Cl. ..... 206/420; 206/464; 206/468; 206/495; 211/26

[58] Field of Search ..... 206/328, 330, 334, 418, 206/419, 420, 421, 422, 461, 464, 467, 468, 495, 485; 362/249, 252, 806; 211/26, 60.1, 89; 242/96, 85.1

[56] References Cited

U.S. PATENT DOCUMENTS

| | | | |
|---|---|---|---|
| 2,951,583 | 9/1960 | Sanford | 206/419 X |
| 2,984,347 | 5/1961 | Kalinchuk | 206/419 |
| 3,384,227 | 5/1968 | Spatz | 206/420 |
| 3,878,941 | 4/1975 | Kelner | 206/419 |
| 4,022,323 | 5/1977 | Yamazaki | 206/419 |
| 4,228,896 | 10/1980 | Wu | 206/420 |
| 4,769,749 | 9/1988 | Felski | 211/26 X |
| 4,795,121 | 1/1989 | Comito | 211/26 X |
| 4,878,586 | 11/1989 | Bancroft et al. | 206/328 X |
| 4,917,323 | 4/1990 | Wing | 242/96 |
| 4,971,200 | 11/1990 | Huang et al. | 206/420 |
| 5,033,619 | 7/1991 | Garis | 206/420 X |
| 5,064,067 | 11/1991 | McAllister et al. | 206/420 |

FOREIGN PATENT DOCUMENTS 2445633 4/1976 Fed. Rep. of Germany .

*Primary Examiner*—Paul T. Sewell
*Assistant Examiner*—Jacob K. Ackun, Jr.
*Attorney, Agent, or Firm*—Geoffrey A. Mantooth

[57] ABSTRACT

A packaging system compactly packages a string of lights for retail sale and for storage after use. The packaging system includes a tray and a container. The tray has support members for supporting the lights and a connecting member for connecting the support members together and for supporting the wire between the lights. The support members have holding clips for securing the lights thereto. Lights are secured to both sides of the support members. The wire connecting the lights together is wound around the connecting member, which is shorter than the support member so as to accommodate the wound wire. The connecting member also has retaining arms for retaining the plug to the tray. The tray and light string are disposed inside of the container. The container has a transparent box so as to allow viewing of at least a portion of the lights therein. A sliding back panel allows the back of the box to be opened, wherein the plug can be removed and the lights tested.

10 Claims, 3 Drawing Sheets

FIG. 5
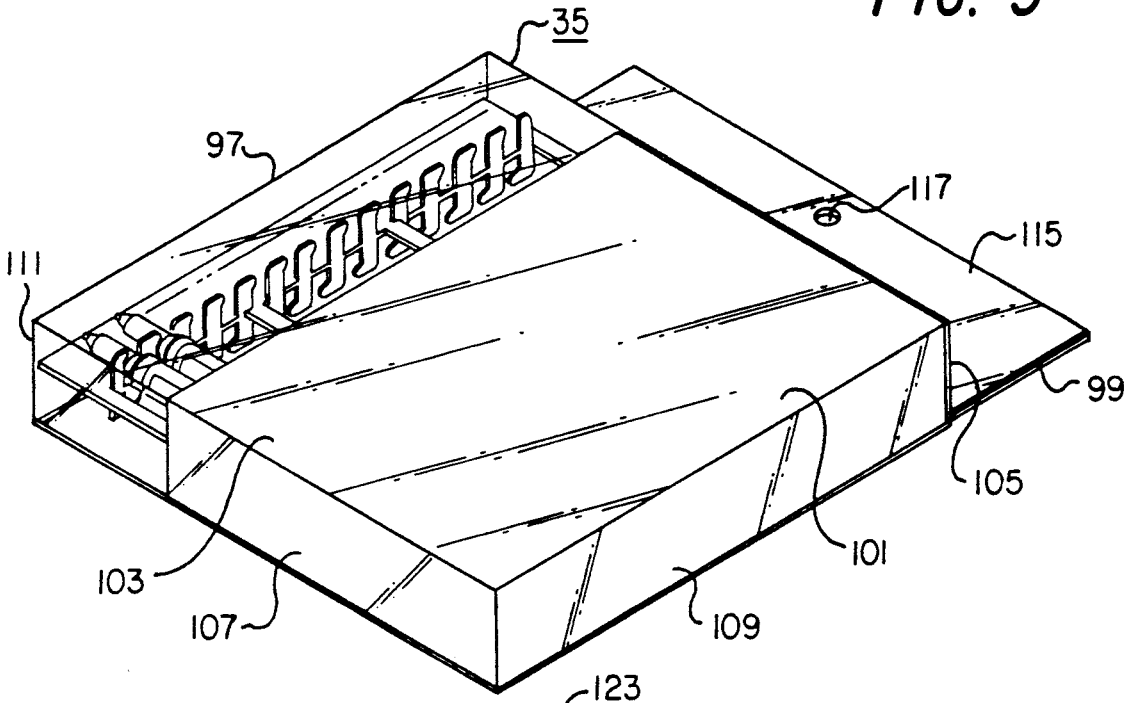
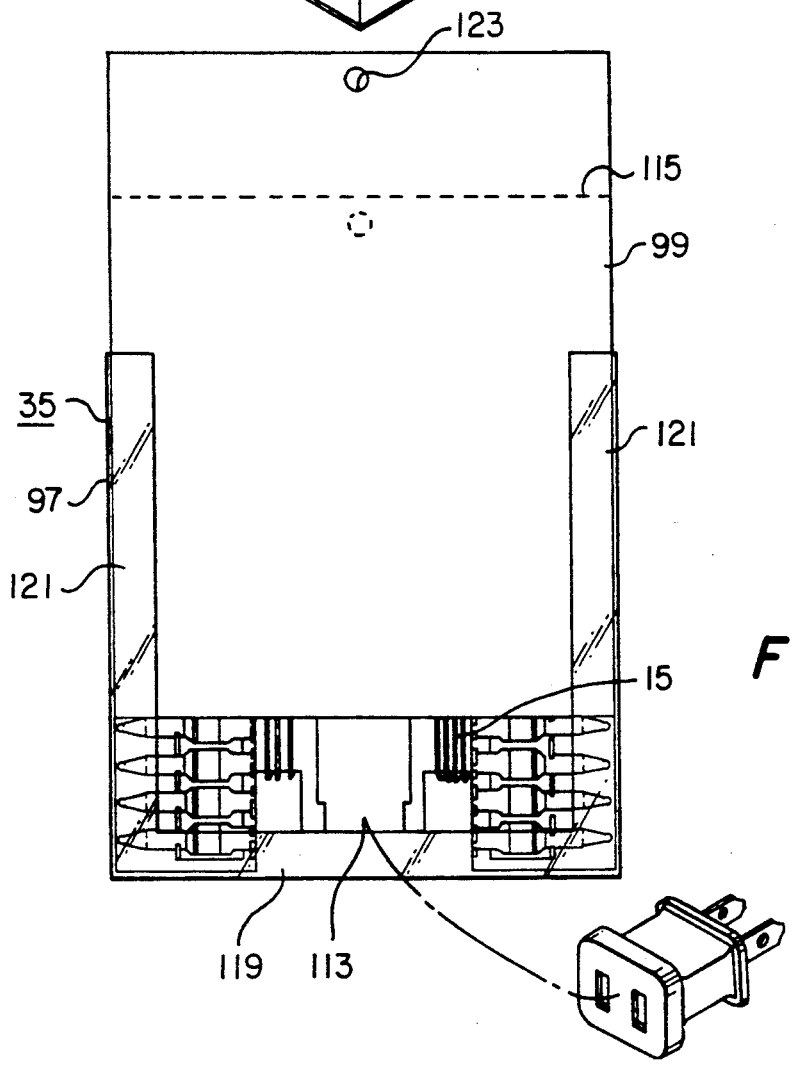
FIG. 6

SYSTEM FOR PACKAGING STRING LIGHTS

FIELD OF THE INVENTION

The present invention relates to systems for packaging string lights, such as lights that are used for Christmas decorations.

BACKGROUND OF THE INVENTION

String lights are made up of plural lights connected together on a string of electrical wires. The string may typically contain between 35 to 200 lights. String lights are commonly used to decorate Christmas trees, objects and houses during the Christmas season.

String lights are typically sold in flat packages suitable for stacking on retail store shelves. One type of prior art package for string lights utilizes a polystyrene foam tray. One side of the tray has rows of cavities therein for receiving the lights. Channels connect the cavities together, wherein the wires are looped and placed in the channels.

One problem with this type of packaging is wasted space. For example, for a string of miniature lights, the thickest component of the string is the plug and/or control box. The miniature lights themselves are less than one-half the thickness of the plug (or control box). By packaging only a single thickness of lights, much space is left unused. The Christmas tree light business is very competitive. Therefore, any advantage, such as reducing the package size to save on shipping and freight or to make the package more attractive to retailers who have a finite amount of shelf space, would be beneficial. In addition to the problem of wasted space, the foam trays are not recyclable and thus contribute to environmental problems.

Another problem with prior art packaging is the difficulty in testing the lights at the retail store. It is desirable to allow a potential buyer to test the string of lights before buying. This assures the buyer that he has a working set of lights. Testing involves merely removing the plug from the package and connecting it to an electric receptacle. But, many prior art packages make the removal of the plug difficult.

Still another problem with prior art packages is the tendency of the wire to easily tangle. Prior art packages have adjacent lights on the string located adjacent to each other in the package. This requires the wire to be coiled in loops and laid on the tray. The coiled wire has a memory that makes the wire tend to coil and tangle during use of the light string and during repackaging. Further still, because the prior art packages use a complicated arrangement of coiled wire, the original packaging is commonly discarded after removing the lights for the first time. Consumers must find another way to repackage the string for storage after use.

SUMMARY OF THE INVENTION

It is an object of the present invention to provide a system for packaging string lights, which system packages the lights more densely and compactly.

Another object of the present invention is to provide a packaging system for a string of lights, which system minimizes the coiling of the wire in the light string.

Still another object of the present invention is to provide a packaging system for a string of lights, which system allows ease of testing the light string by a potential buyer at a retail establishment.

The packaging system of the present invention includes a tray for packaging a string of lights. The string of lights includes plural lights and connecting wire therebetween. The string of lights has a plug. The tray includes a support member for supporting the lights, a winding member for supporting the wire and a retaining means for retaining the plug to the tray. The support member has first and second opposite sides at first and second ends. Each side of the support member has plural holding means coupled thereto. Each of the holding means is for holding and securing one of the lights to the respective support member. The plural holding means on each side extend between the first and second ends. The holding means on each side are closely spaced to each other. A winding member is coupled to the support member at a location adjacent to the plural holding means. The winding member is shorter than the length of the support member between the first and second ends so as to create notches in the winding member. The notches are adapted to receive the wire, wherein the wire can be wound around the winding member. The retaining means is coupled to the winding member.

In another aspect, the packaging system includes a tray comprising a support member, a winding member and the retaining means and a box. The box has an interior cavity. The box interior cavity receives the tray. The box has an open side. A back panel covers the box open side. The back panel is slidingly coupled to the box so that the back panel can be slid so as to expose the interior cavity of the box, wherein the back panel allows the testing of the light string.

In another aspect, the packaging system includes a tray that includes a support member, a winding member and the retaining means. Also, there is a transparent rectangular box having an interior cavity for receiving the tray. The tray is located in the interior cavity. The box has a front side and four edge sides. The box has an extension extending out from the box. The extension has an opening therethrough such that the box can be hung from a hook engaging the extension opening, wherein the front side can be displayed. A card is located in the box interior cavity. The card is interposed between the tray and the front side of the box and between the tray and two adjacent edge sides of the box. The card allows viewing of the tray from outside the box. The card contains printed matter suitable for display, wherein the box can be located so that one of the two adjacent edge sides can be displayed.

The packaging system of the present invention allows the lights and wires to be compactly packaged onto a tray. Lights are located on both sides of the flat tray, and the wire is wound on itself, thereby increasing the density. For miniature lights, the thickness of the package is still dictated by the plug (and, on those light strings equipped with one, a control box), which is the thickest element of the string. Thus, package thickness has not been increased. This high density packaging arrangement allows the overall package size to be reduced, thereby reducing those shipping and freight costs of the packaging system that are based on volume. Furthermore, the reduced packaging size allows the retailer to more efficiently use its finite shelf space to display the light strings.

Furthermore, the wire is wound onto the tray without the excessive coiling of prior art packages. This reduces the tendency of coiled wire to tangle, thereby simplifying the use and repackaging of the light string.

The tray is sized so that the spacing between the holding means on opposite ends and opposite sides of each support member is about the same as the light interval along the string. This allows the lights to be repackaged in an orderly manner.

The container has a slidable back panel that allows the plug to be removed easily from the package for testing by a potential buyer at a retail store. The tray has two retaining arms that allow the plug to be slid out of the open back side of the container.

The container can be displayed in one of three ways, allowing the retailer more flexibility in displaying the packaging system. The container can be hung vertically from a hook. Alternatively, the container can be stacked horizontally on a shelf in one of two orientations. Thus, the retailer can optimize its finite display space in displaying the packaging system by selecting the particular display orientation best suited for the display space.

BRIEF DESCRIPTION OF THE DRAWINGS

FIG. 5 is an isometric view of the container of FIG. 4.

FIG. 6 is a back view of the container, showing the back panel lifted up and the plug removed for testing the light string.

DESCRIPTION OF THE PREFERRED EMBODIMENT

The packaging system of the present invention is used to compactly store a string of lights for retail sale. Such light strings are typically used at Christmas or other festive times for decorative purposes.

Figure 2:
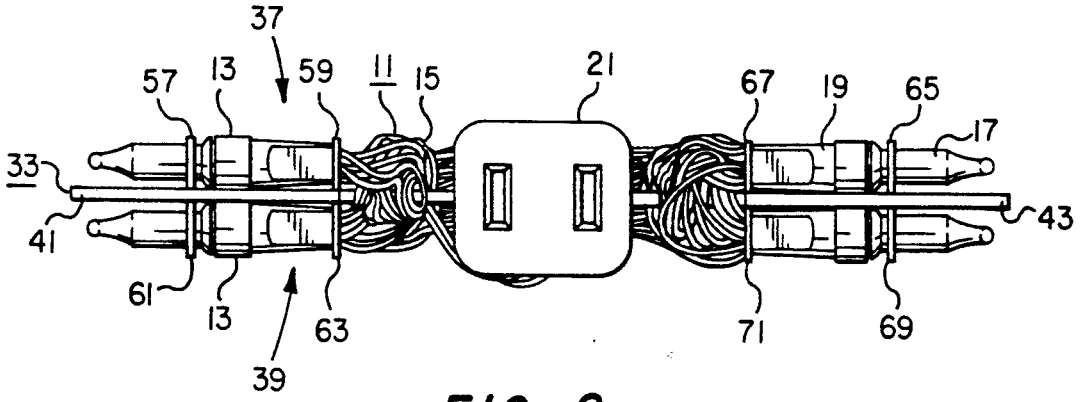
FIG. 2 is an end view of the tray of FIG. 1.

Referring to FIG. 2, the light string 11 includes plural lights 13 joined together by conductive wires 15. The lights 13 are generally spaced apart from each other by a constant distance along the string. For example, for mini or miniature lights, the lights are located about every 6 inches along the string. Each light 13 has a bulb 17, and a socket 19 for receiving the bulb. The bulbs are removable from their respective sockets to allow replacement of defective bulbs. Each light 13 is generally elongated with the bulb 17 protruding from one end of the socket 19 and the wires 15 protruding from the other end of the socket. The end of the string terminates into a male plug 21 which can be plugged into an electrical receptacle. The string may be of the end-to-end type, wherein one end of the string terminates in the male plug 21 while the other end terminates in a female plug 23 (see FIG. 3). Some light strings are equipped with control boxes (not shown) for controlling, for example, chasing parameters.

Figure 1:
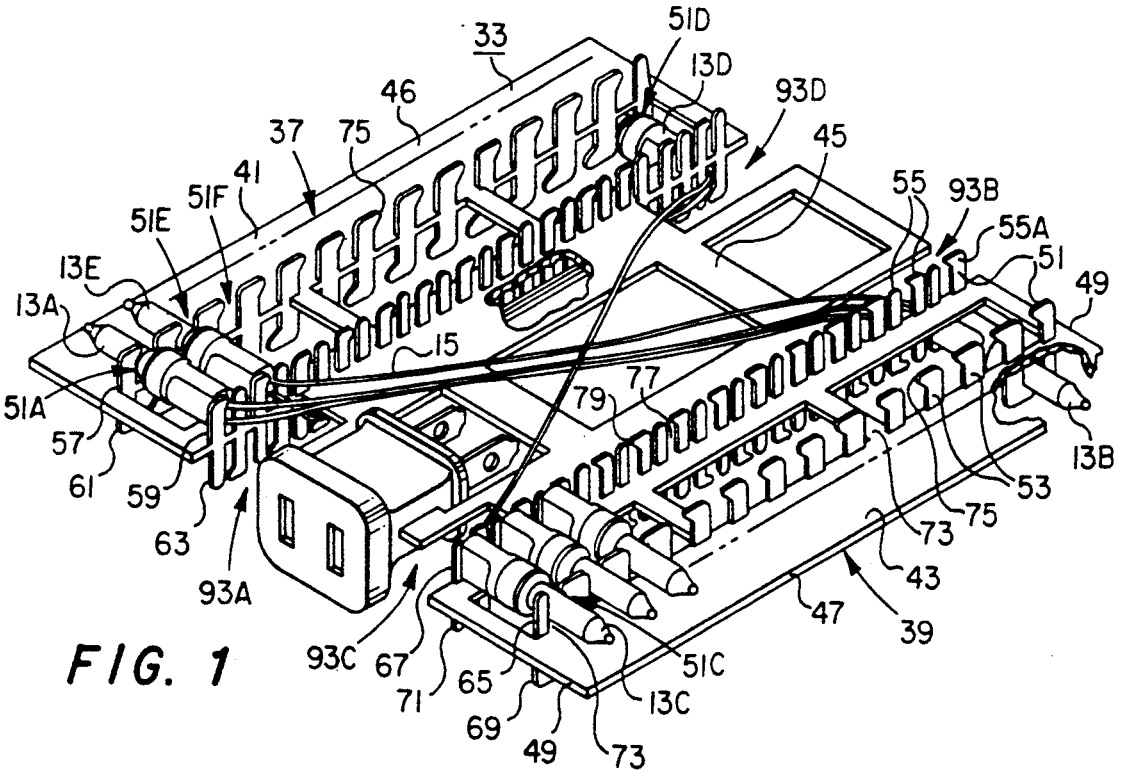
FIG. 1 is an isometric view of the tray of the packaging system of the present invention, in accordance with a preferred embodiment, onto which a string of lights has been wound.
Figure 4:
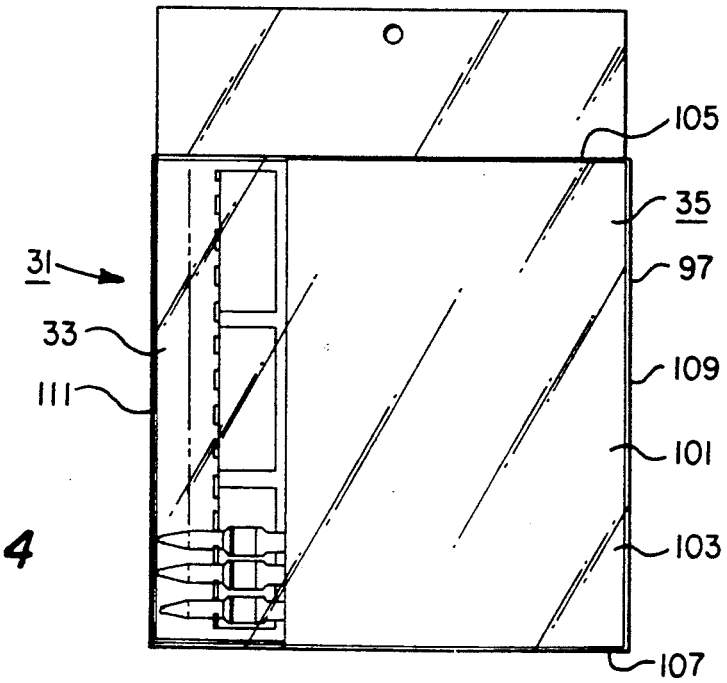
FIG. 4 is a front view of the container of the packaging system of the present invention, in accordance with a preferred embodiment, with a tray and a light string shown therein.

The packaging system 31 of the present invention includes a tray 33 and a container 35 (see FIGS. 1 and 4). The lights 13 on the string 11 are secured onto the tray 33, with the wire 15 being wrapped around the tray. The tray has retaining arms for receiving the plug 21. The tray 33 and the light string 11 are received by the container 35. The container 35 can be displayed in one of several orientations thereby allowing the retailer to adapt the packaging system to the particular circumstances of the retailer. In addition, the container allows the plug to be removed for testing by a prospective buyer.

Figure 3:
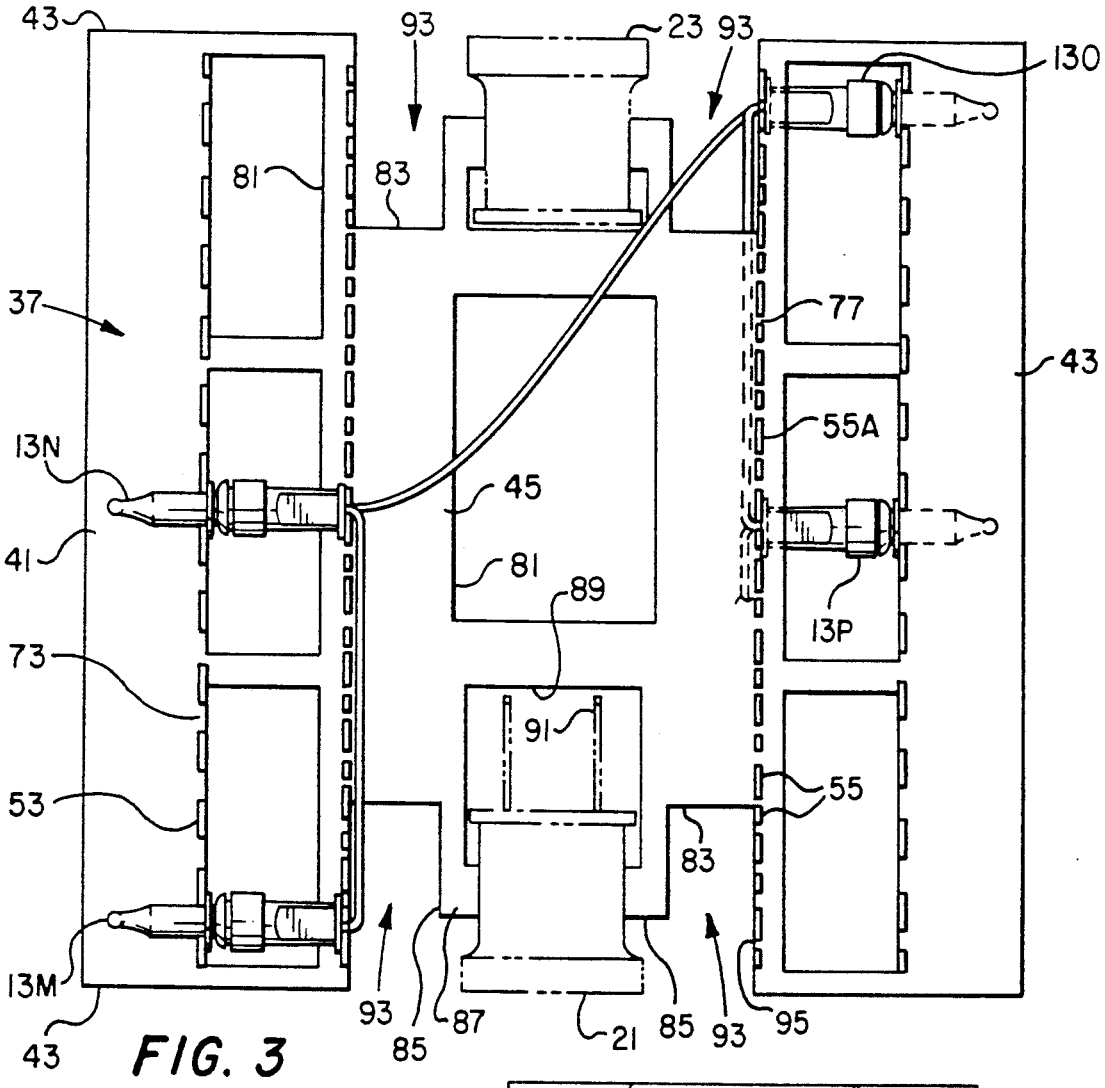
FIG. 3 is a plan view of the tray, shown without any light string thereon.

In FIGS. 1–3, there is shown the tray 33 of the packaging system 11 of the present invention, in accordance with a preferred embodiment. In FIGS. 1, 4 and 5, only a portion of a light string 11 is shown wrapped around the tray for clarity and viewing the different members of the tray.

The tray 33 has two faces or sides. Referring to the orientation of FIGS. 1 and 2, there is an upper side 37 and a lower side 39. The tray has first and second support members 41, 43 that support the lights 13. The support members 41, 43 extend between two ends. Coupling the support members together is a connecting member 45 that supports the wire 15.

Each support member 41, 43 is made out of a flat, generally rectangular plate 46. Each support member has a side edge 47 and two end edges 49. Projecting out from each plate 46 are plural holding means 51 for holding the lights 13 in place onto the tray. In the preferred embodiment, the holding means 51 for each light includes plural first and second projections 53, 55 that extend perpendicularly outward from the respective support member plates 46. The projections are generally flat and are aligned in rows along each side of the tray. Thus, there is a row 57 of first projections 53 and a row 59 of second projections 55 on the upper side 37 of the first support member 41, and a row 61 of first projections 53 and a row 63 of second projections 55 on the lower side 39 of the first support member 41. Likewise, there are respective rows 65, 67 of first and second projections 53, 55 on the upper side 37 of the second support member 43 and respective rows 69, 71 of first and second projections on the lower side 39 of the second support member 43.

The first projections 53 in each row are spaced apart from each other so as to form a gap 73 or notch between projections. Each gap 73 receives a bulb 17. The size of each gap 73 is only slightly larger than the outside diameter of a bulb 17. At the outer end of each projection is a small retaining tab 75 that extends laterally to reduce the size of the gap. Each retaining tab 75 is spaced from the plate 46 by a distance that is slightly greater than the outside diameter of the bulb 17. When a bulb 17 is installed into a gap 73, the bulb is clamped between the two adjacent projections, the plate 46 and the retaining tab 75. The retaining tab 75 prevents the bulb from slipping out of the gap. The first projections 53 are flexible, allowing a bulb 17 to be snapped in and out of the respective gap. The bulb, as it passes the retaining tab, causes the projections to spread apart, wherein the bulb can be located within or without the gap.

The second projections 55 are also spaced apart from each other so as to form a gap 77. For each light, there is provided a set of two separate second projections. The wires 15 exiting the light socket are received by the gap 77 between the respective second projections 55. One of the projections 55A in each set has a retaining tab 79 that extends laterally so as to reduce the size of the gap 77. The retaining tab 79 narrows the size of the gap 77 at the open end to a size that is less than the outside diameter of the wire. Thus, when the wire is inserted into the gap by flexing the projections apart, it is retained therein by the retaining tab.

The tray 33 can be provided with extra holding means 51 on the support members, so as to allow the retention of spare bulbs.

The connecting member 45 connects the first and second support members 41, 43 together. The connecting member 45 is also a flat plate that is coupled to the first and second support members. The connecting member 45 and both support members 41, 43 have openings 81 therethrough. Such openings 81 are to minimize the amount of material required for fabrication and also to reduce the weight of the tray.

The tray 33 is made of molded plastic and is a single unit. Thus, the connecting member 45 and the support members 41, 43 and the holding means 51 are all integral with each other. The connecting member and support members are coplanar.

The connecting member 45 has end edges 83. The distance between the end edges 83 of the connecting member is less than the distance between the end edges 43 of the support members 41, 43 so that the connecting member is shorter than the support members. Thus, the two support members 41, 43 and the connecting member 45 for an "H" shaped arrangement when viewed in plan view, as in FIG. 3. The shorter connecting member is flanked by the longer support members.

A pair of retaining arms 85 are provided on each end of the connecting member 45. The "L" shaped receiving arms 85 clip the plugs 21, 23 to the tray 33. Each retaining arm 85 extends out from a respective end edge 83 of the connecting member 45. At the free ends of the arms are projections 87 which extend toward the opposite arm. When the plug is received by the retaining arms 85 an interference fit between the plug and the projections 87 is formed. In the case of the male plug 21, a notch 89 is formed in the end edge of the connecting member so as to receive the conductive leads 91 of the plug, as shown in FIG. 3. The receiving arms 85 are coplanar with the connecting member 45.

Notches 93 for receiving the wires 17 are formed in the tray 33. Each notch 93 is formed by an end edge 83 of the connecting member, a receiving arm 85 and an inner edge 95 of the respective support member. Thus, there are four notches 93; two notches adjacent to each support member 41, 43.

The installation of the light string 11 onto the tray 33 will now be described with reference to FIG. 1. Each light is located within a holding means 51. The light is aligned with the gaps 73, 75 between the projections and is simply forced down. This forces the projections apart and allows the light to enter the gaps. When each light 13 is installed, it is firmly retained to the tray 33. The retaining tabs 75, 79, projections 53, 55 and support member plate 46 constrain movement of the light in two dimensions, while movement in the third dimension, along the longitudinal axis of the light, is prevented by the light being located between the first and second sets of projections 53, 55. The light is oriented so that the wire end is located closest to the connecting member, or the center of the tray.

The wire 15 between each light is wound around the connecting member and through the notches 93, as described in more detail hereinbelow.

The plugs are clipped to the tray between the receiving arms 85. The male plug 21 is clipped to one end, while the female plug 23, if there is one, is clipped to the other end of the tray. The excess wire between the plugs and the nearest lights is first wound around the tray through the notches before clipping in the plugs. Each plug is secured to the tray by locating the plug above or below the tray and then bringing the plug into the gap between the retaining arm projections 87. Thus, the plugs, and in particular the male plug 21, is able to be easily removed from the tray 33 by slipping the plug out from between the retaining arms. This is useful when the lights are tested, as will be explained in more detail hereinbelow.

The filled tray compactly packages the light string thereon. Lights are located on both the upper and lower sides 37, 39 of the tray. Also, the lights are closely spaced together in rows, with the wire wrapped neatly around the tray. For the miniature lights shown in the Figs., the double layer of lights is about the same thickness as the plug (see FIG. 2). Thus, the thickness of the tray has been made as small as possible.

In the preferred embodiment, the tray 33 is sized according to the distance between the lights on the string. If the distance between lights on the string is about 5½ inches, then the distance from an endmost holding means 51A on the upper side 37 of the support member 41 to the endmost holding means 51B on the opposite end and on the lower side 39 of the same support member is about 5 to 5½ inches or some multiple thereof.

This correspondence between light spacing on the string and spacing of the holding means keeps the wire 15 fairly taut as the wire is wrapped around the tray. This spacing of the holding means 51 also allows for simplicity and orderliness when winding the string onto the tray.

For example, the first light 13A is located in a first holding means 51A on the upper side 37 of the first support member 41. This first holding means 51A is located at a first end of the tray. The wire from the first light 13A is then crossed over the connecting member 45 to the second support member 43 toward the opposite end of the tray. The wire is passed around the opposite or second end by way of the notch 93B, wherein the second light 13B is located in a holding means 51B on the lower side 39 of the second support member 43. This holding means is the endmost holding means, nearest to the second end of the tray. Next, the wire from the second light 13B is passed along the lower side 39 of the connecting member 45 and through the notch 93C, wherein the third light 13C is located in a holding means 51C on the opposite side 37 of the second support member 43. This third holding means 51C is located on the same end of the tray as the first holding means 51A. Next, the wire from the third light 13C is crossed over the connecting member 45 and passed through the notch 93D to the lower side 39 of the tray. The fourth light 13D is then inserted into a holding means 51D on the lower side of the first support member 41. The holding means 51D is the endmost holding means on the opposite end of the tray from the first holding means 51A. Next, the wire from the fourth light 13D is passed along the connecting member and through the notch 93A to the upper side 37 of the tray. The fifth light 13E is located in the holding means 51E that is adjacent to the first holding means 51A. The process is repeated, winding the wire around the tray through the notches and inserting the lights into the holding means.

As the string is wound onto the tray 33, the lights on a side of a support member are laid side by side, from one end of the tray to the other. Thus on the upper side 37 of the first support member 41, the first light 13A is inserted into the endmost holding means 51A. The second light 13E to be located on the upper side of the first support member is located in the next holding means 51E. The third light to be located on the upper side of the first support member is located in the next holding means 51F, and so on, moving from one end of the tray to the other end in an orderly fashion. Lights located on the upper side 37 of the second support member 43 also progress in the same direction as the lights on the upper side of the first support member. Lights on the lower sides 39 of the first and second members progress in the opposite direction, from the second end of the tray to the first end. However, during the winding process, the tray is flipped over on its ends every time the wire is passed through a notch so that the lower side becomes the upper side and vice versa. The lights on the new upper side progress in the same direction as the lights on the old upper side. Thus as the tray is flipped over when winding, the lights on the current upper side of the tray always progress in the same direction, maintaining consistency of direction in the progression of the placement of the lights on the support members.

This arrangement stretches the wire out as it is being wound onto the tray, thereby minimizing any chance of entanglement later on when the string is used or repackaged. Furthermore, the orderliness of the arrangement encourages a user to reutilize the tray when storing the light string after use. The user can easily rewind the string back onto the tray after use.

The length of the tray from end to end may be sized at some multiple of the light spacing interval. For example, the tray could be 10–11 inches in length to accommodate light strings with many lights. For such a tray, two (or more) adjacent lights are located on each side of each support member before the string is passed through a notch to the other side of the tray. For example, as shown in FIG. 3, the first two lights 13M, 13N would be located on the upper side 37 of the first support member 41. The first light 13M would be located in an endmost holding means, while the second light 13N would be located in the middle, between the ends of the tray. The second light 13N would be spaced away from the first light a sufficient distance to keep the wire fairly taut. Then, the wire from the second light 13N is passed through the appropriate notch to the other side of the tray, and the tray is flipped over to continue inserting lights 130, 13P etc.

The container 35 will now be described, referring to FIGS. 4–6. The container 35 includes a transparent plastic box 97, a back panel 99 and a card 101 located inside of the box.

The rectangular box 97 has a front side 103, four edge sides 105, 107, 109, 111 and an open back 113. The open back provides access to the hollow interior of the box. The box 97 is made of a transparent, semi-rigid plastic such as is commonly used in packaging. The box 97 has an extension 115 that extends out from the upper end of the box. The extension 115 is integral to the top edge side 105 of the box and has an opening 117 therein for hanging the box from a hook for display.

The back of the box has a bottom channel member 119 and two side channel members 121. The channel members 119, 121 extend perpendicularly from the edge sides 107, 109, 111 of the box for a short distance. The channel members 119, 121 create channels along their inside surfaces so as to receive the back panel 99. The back panel 99 is slid along the inside of the channel members to close off the back side 113 of the box. The back panel 99 can slide inside of the channel members to open and close the back side of the box. When fully closed, the back panel 99 extends from the bottom of the box to the top of the extension 115. Thus, the back panel also has an opening 123, which is aligned with the opening 117 when the back panel is fully closed. The back panel is typically made of cardboard.

The interior of the box receives the tray 33 and the light string Interposed between the tray and the sides of the box is the card 101 The card 101 is made of thin cardboard and generally has printed matter thereon for conveying information about the light string to a buyer. The card does not cover all sides of the box. Instead, the left side of the container, referring to the orientation of FIG. 4, is left uncovered to display a portion of the light string inside of the box. Thus, a portion of the front side 103 and the bottom edge side 107 of the box is left uncovered, as is the entire left edge side 111.

A retailer can display the packaging system 11 of the present invention in any one of three ways. The container 35 can be displayed hanging from a hook, wherein the hook is received by the openings 117, 123. Alternatively, the container can be laid on a shelf on its back panel 99 with the bottom edge side 107 showing or with the right edge side 109 showing to the consumer. Such flexibility in display allows the retailer to adapt the packaging system of the present invention to the particular display arrangement available to the retailer.

A potential buyer can test the light string in the container before making a purchase. This assures the buyer that the light string is operational. To test the string, the potential buyer slides the back panel 99 upwardly as shown in FIG. 6. The plug 21 is removed from the tray 33. The retaining arm 85 allows the plug 21 to be removed out of the back of the container. The plug is plugged into an electrical receptacle to test the string. After testing, the plug is placed back inside of the box and the back panel is closed.

The foregoing disclosure and the showings made in the drawings are merely illustrative of the principles of this invention and are not to be interpreted in a limiting sense.

We claim:

1. A tray for packaging a string of lights, said string of lights comprising plural lights and connecting wire therebetween, said string of lights having a plug, the tray comprising:

a) a support member for supporting said lights, said support member having first and second opposite sides and first and second ends, each side of said support member having plural holding means coupled thereto, each of said holding means being for holding and securing one of said lights to said respective support member, said plural holding means on each side extending between said first and second ends, said holding means on each side being closely spaced to each other;

b) a winding member for supporting said wire, said winding member being coupled to said support member at a location adjacent to said plural holding means, said winding member being shorter than the length of said support member between said first and second ends so as to create notches in said winding member, said notches being adapted to receive said wire, wherein said wire can be wound around said winding member;

c) retaining means for retaining said plug to said tray, said retaining means being coupled to said winding member.

2. A tray for packaging a string of lights, said string of lights comprising plural lights and connecting wire therebetween, said string of lights having a plug, the tray comprising:

a) first and second support members for supporting said lights, each of said support members having first and second opposite sides and first and second ends, each side of said support members having plural holding means coupled thereto, each of said holding means being for holding and securing one of said lights to said respective support member, said plural holding means on each side of said support member extending between said first and second ends;

b) said first and second support members being separated from each other by a connecting member, said connecting member being coupled to said first and second support member at respective locations that are adjacent to said plural holding means, said connecting member being shorter than the length of said first and second support members between said first and second ends so as to create notches in said tray, said notches being adapted to receive said wire, wherein said wire can be wound around said connecting member;

c) retaining means for retaining said plug to said tray, said retaining means being coupled to said connecting member, said retaining means comprising arms that are separated by a gap, said gap being adapted to receive said plug.

3. A packaging system, comprising:

a) a light string, said light string having plural lights, each of said lights having a bulb end and a wire end, said light string having conductive wire that electrically couples said lights together, said wire being coupled to the wire end of each of said lights;

b) first and second support members for supporting said lights, each of said support members having first and second opposite sides and first and second ends, each side of said support member having plural holding means coupled thereto, each of said holding means holding and securing one of said lights to said respective support member;

c) said first and second support members being separated from each other by a connecting member, said connecting member being coupled to said first and second support members, said connecting member being shorter than the length of said first and second support members between said first and second ends so as to create notches;

d) each of said lights on said respective support member being oriented so that the wire end of said light is adjacent to said connecting member;

e) said wire being wound around said connecting member, through said notches.

4. The packaging system of claim 3, wherein:

a) said lights are spaced along said string at an interval;

b) the spacing between said holding means on said opposite sides and opposite ends of each of said first and second support members corresponds to said interval.

5. A tray for packaging a string of lights, said string of lights comprising plural lights and connecting wire therebetween, the tray comprising:

a) a flat, generally "H" shaped member having two lateral portions that are spaced apart from each other and a connecting portion extending between said lateral portions, said member having first and second ends, said lateral portions extending between said ends, said member having notches formed in said ends at said connecting portion;

b) each of said lateral portions having two opposite sides, each of said sides having projections extending outwardly therefrom, said projections being from said first end to said second end, said projections being separated from each other by a gap, said respective gaps being adapted to receive one of said lights;

c) each of said gaps having retaining means for retaining said light within said gap, said retaining means being coupled to one of said projections forming said gap.

6. A packaging system, comprising:

a) a light string, said light string having plural lights, each of said lights having a bulb end and a wire end, said light string having conductive wire that electrically couples said lights together, said wire being coupled to the wire end of each of said lights;

b) a flat, generally "H" shaped member having two lateral portions that are spaced apart from each other and a connecting portion extending between said lateral portions, said member having first and second ends, said lateral portions extending between said ends, said member having notches formed in said ends at said connecting portion;

c) each of said lateral portions having two opposite sides, each of said sides having projections extending outwardly therefrom, said projections being from said first end to said second end, said projections being separated from each other by a gap, said respective gaps being adapted to receive one of said lights;

d) each of said gaps having retaining means for retaining said light within said gap, said retaining means being coupled to one of said projections forming said gap.

e) said wire being wound around said connecting portion and through said notches.

7. A packaging system for packaging a string of lights, said string of lights comprising plural lights and connecting wire therebetween, said string of lights having a plug, said packaging system comprising:

a) a tray comprising a support member, a winding member and a retaining means;

b) said support member for supporting said lights, said support member having first and second opposite sides and first and second ends, each side of said support member having plural holding means coupled thereto, each of said holding means being for holding and securing one of said lights to said respective support member, said plural holding means on each side extending between said first and second ends, said holding means on each side being closely spaced to each other;

c) said winding member for supporting said wire, said winding member being coupled to said support member at a location adjacent to said plural holding means, said winding member being shorter than the length of said support member between said first and second ends so as to create notches in said winding member, said notches being adapted to receive said wire, wherein said wire can be wound around said winding member;

d) said retaining means for retaining said plug to said tray, said retaining means being coupled to said winding member;

e) a box having an interior cavity, said box interior cavity receiving said tray, said box having an open side;

f) a back panel that covers said box open side, said back panel being slidingly coupled to said box so that said back panel can be slid so as to expose said interior cavity of said box, wherein said back panel allows the testing of said lights string.

8. The packaging system of claim 7 wherein said retaining means comprises arms that are separated by a gap, said gap being adapted to receive said plug, said arms being located adjacent to said box open side, wherein said plug can be removed through said box open side for testing of said light string.

9. A packaging system for packaging a string of lights, said string of lights comprising plural lights and connecting wire therebetween, said string of lights having a plug, said packaging system comprising:

a) a tray comprising a support member, a winding member and a retaining means;

b) said support member for supporting said lights, said support member having first and second opposite sides and first and second ends, each side of said support member having plural holding means coupled thereto, each of said holding means being for holding and securing one of said lights to said respective support member, said plural holding means on each side extending between said first and second ends, said holding means on each side being closely spaced to each other;

c) said winding member for supporting said wire, said winding member being coupled to said support member at a location adjacent to said plural holding means, said winding member being shorter than the length of said support member between said first and second ends so as to create notches in said winding member, said notches being adapted to receive said wire, wherein said wire can be wound around said winding member;

d) said retaining means for retaining said plug to said tray, said retaining means being coupled to said winding member;

e) a transparent rectangular box having an interior cavity for receiving said tray, said tray being located in said interior cavity, said box having a front side and four edge sides that are adjacent to said front side, said box having an extension extending out from one of said edge sides, said extension having an opening therethrough such that said box can be hung from a hook engaging said extension opening, wherein said front side can be displayed;

f) a card located in said box interior cavity, said card being interposed between said tray and said front side of said box and between said tray and two adjacent edge sides of said box, said card allowing viewing of said tray from outside of said box, said card containing printed matter suitable for display, wherein said box can be located so that one of said two adjacent edge sides can be displayed.

10. The packaging system of claim 9, wherein:

a) said box having an open back side;

b) a back panel that covers said box open side, said back panel being slidingly coupled to said box so that said back panel can be slid so as to expose said interior cavity to said box, wherein said back panel allows the testing of said light string.

* * * * *